US011076731B2

(12) United States Patent
Park et al.

(10) Patent No.: US 11,076,731 B2
(45) Date of Patent: Aug. 3, 2021

(54) VACUUM CLEANER

(71) Applicant: Samsung Electronics Co., Ltd., Suwon-si (KR)

(72) Inventors: Dah We Park, Seoul (KR); Joo Hee Ryu, Goyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 321 days.

(21) Appl. No.: 16/302,904

(22) PCT Filed: May 10, 2017

(86) PCT No.: PCT/KR2017/004803
§ 371 (c)(1),
(2) Date: Nov. 19, 2018

(87) PCT Pub. No.: WO2017/200233
PCT Pub. Date: Nov. 23, 2017

(65) Prior Publication Data

US 2019/0290085 A1 Sep. 26, 2019

(30) Foreign Application Priority Data

May 18, 2016 (KR) ..... 10-2016-0060855

(51) Int. Cl.
*A47L 9/04* (2006.01)
*A47L 9/02* (2006.01)

(52) U.S. Cl.
CPC ..... *A47L 9/0477* (2013.01); *A47L 9/02* (2013.01); *A47L 9/04* (2013.01)

(58) Field of Classification Search
CPC ..... A47L 5/05; A47L 5/10; A47L 5/28; A47L 5/30; A47L 5/34; A47L 9/0461; A47L 9/0477; A47L 9/0494
(Continued)

(56) References Cited

U.S. PATENT DOCUMENTS 4,084,282 A * 4/1978 Calvert ..... A45D 24/46 119/609
5,482,562 A * 1/1996 Abernathy ..... A46B 13/02 134/33

(Continued)

FOREIGN PATENT DOCUMENTS

JP 5-95868 A 4/1993
JP 8-56877 A 3/1996

(Continued)

OTHER PUBLICATIONS

European Search Report dated Apr. 16, 2019, issued in European Patent Application No. 17799591.7.

*Primary Examiner* — Joseph J Hail
*Assistant Examiner* — Arman Milanian
(74) *Attorney, Agent, or Firm* — Jefferson IP Law, LLP

(57) ABSTRACT

A cleaner including a cleaning module capable of easily removing foreign matters such as hair entangled in a brush unit is provided. The cleaner includes a main body including a suction port, a brush unit rotatably provided at the suction port, and a cleaning module detachably received in the main body and configured to remove a foreign matter entangled in the brush unit. The cleaning module includes a housing detachably received in the main body, a cartridge provided in the housing to be movable in a vertical direction, and a cutting unit provided at a lower portion of the cartridge and configured to cut the foreign matter entangled in the brush unit.

13 Claims, 14 Drawing Sheets

(58) Field of Classification Search
USPC ..... 15/48, 383
See application file for complete search history.

(56) References Cited

U.S. PATENT DOCUMENTS

| | | | | |
|---|---|---|---|---|
| 2009/0229075 | A1* | 9/2009 | Eriksson | A47L 11/4041 15/383 |
| 2010/0287717 | A1* | 11/2010 | Jang | A47L 11/4041 15/41.1 |
| 2013/0042429 | A1* | 2/2013 | Misumi | A46B 17/06 15/415.1 |
| 2013/0192021 | A1 | 8/2013 | Eriksson | |
| 2013/0198995 | A1* | 8/2013 | Eriksson | A47L 9/2894 15/383 |
| 2014/0259521 | A1* | 9/2014 | Kowalski | A47L 5/30 15/383 |
| 2014/0359968 | A1* | 12/2014 | Eriksson | A47L 9/0494 15/390 |

FOREIGN PATENT DOCUMENTS

| | | | |
|---|---|---|---|
| JP | 2008-259718 | A | 10/2008 |
| KR | 10-1389316 | B1 | 4/2014 |
| WO | 2015/118981 | A1 | 8/2015 |

* cited by examiner

VACUUM CLEANER

TECHNICAL FIELD

The present disclosure relates to a cleaner including a cleaning module capable of removing foreign matters such as hair entangled in a brush unit.

BACKGROUND ART

Generally, a cleaner is a device for sweeping or scattering foreign matters such as dust or hair existing in a space to be cleaned, and cleaning an area to be cleaned by suctioning the foreign matters such as the scattered dust or hair with a suction force.

A vacuum cleaner for suctioning foreign matters such as dust or hair with a suction force is provided with a suction port in a lower portion of a main body, and a brush unit is rotatably arranged in the suction port.

When the foreign matters such as dust or hair existing in a space to be cleaned are scattered by rotation of the brush unit, the scattered dust or hair is suctioned through the suction port by the suction force generated inside the main body, and the suctioned foreign matters are moved into a dust box.

Some of the foreign matters such as hair are not sent directly to the dust box through the suction port but are entangled in the brush unit, reducing the cleaning efficiency because the brush unit is rotated while being entangled with the foreign matters such as hair.

In order to improve the cleaning efficiency, it is necessary to remove the entangled foreign matters from the brush unit. It is inconvenient to stop the operation of the cleaner and separate the brush unit from the main body so as to remove the foreign matters entangled in the brush unit.

DISCLOSURE

Technical Problem

It is an aspect of the present disclosure to provide a cleaner including a cleaning module capable of removing foreign matters such as hair entangled in a brush unit.

Technical Solution

In accordance with an aspect of the present disclosure, a cleaner includes a main body including a suction port, a brush unit rotatably provided at the suction port, and a cleaning module detachably received in the main body and configured to remove a foreign matter entangled in the brush unit, wherein the cleaning module includes a housing detachably received in the main body, a cartridge provided in the housing to be movable in a vertical direction, and a cutting unit provided at a lower portion of the cartridge and configured to cut the foreign matter entangled in the brush unit.

The brush unit may include a brush drum having a drum shape and a brush provided on an outer peripheral surface of the brush drum, and the brush unit may be housed in a cylindrical cover.

A receiving portion to receive the cleaning module may be provided above a central portion of the cylindrical cover, and the receiving portion may include an upper opening through which the housing is received and a lower opening through which the cutting unit is vertically moved.

The cylindrical cover may be provided with an opening portion at a position corresponding to the lower opening.

A lid may be coupled to the main body to open or close the upper opening and the lid may include a pressing portion provided at a lower portion of the lid to press the cartridge.

A pair of anti-release members may be provided at an upper portion of the housing to prevent the cartridge from being released to the outside through the upper opening.

The housing and the cartridge may include support portions for supporting one end and the other end of a spring, respectively, such that the cartridge is elastically supported by the housing via the spring.

The pressing portion may press an upper portion of the cartridge such that the cartridge is moved downward inside the housing when the lid is closed after the cleaning module is received in the receiving portion.

The cutting unit may be inserted into the cylindrical cover through the lower opening and the opening portion when the cartridge is moved downward The spring may be compressed to store elastic force when the cartridge is moved downward.

The cutting unit may be disposed at a central portion of the brush unit, and a blade of the cutting unit may extend in a radial direction of the brush unit to be disposed to cut the foreign matter entangled in the brush unit.

The cartridge may be released from the pressing portion and moved upward in the housing due to the elastic force of the spring when the lid is opened.

The cutting unit may be received in the housing when the cartridge is moved upward.

In accordance with an aspect of the present disclosure, a cleaner includes a main body including a suction port, a brush unit rotatably provided at the suction port, a rotary unit rotatably provided at one side of the brush unit, and a cleaning module configured to remove foreign matter entangled with the brush unit, wherein the cleaning module includes a rotation bar rotatably provided in the main body, a rotation guide part that is provided at one side of the rotation bar to be in contact with the rotary unit and guides the rotation bar to rotate when the rotary unit rotates, and a cutting unit provided at the other side of the rotation bar to be positioned at a central portion of the brush unit, a blade of the cutting unit being disposed to extend in a radial direction of the brush unit to cut foreign matter entangled with the brush unit.

The brush unit may include a brush drum having a drum shape and a brush provided on an outer peripheral surface of the brush drum, and the brush unit may be housed in a cylindrical cover. A support portion for supporting the cutting unit may be provided at a central portion of the cylindrical cover.

A penetrating portion may be formed in a lower portion of the support portion to allow the cutting unit to pass through the penetrating portion and be inserted into the cylindrical cover.

The rotation bar may be elastically supported on the main body by a torsion spring.

When the rotary unit is rotated in a first direction, the rotation guide part guides the rotation bar to rotate in a second direction opposite to the first direction so that the cutting unit is inserted into the cylindrical cover and the torsion spring stores an elastic force.

When the rotary unit is rotated in the second direction, the rotation bar is rotated in the first direction by the elastic force so that the cutting unit is released from the inside of the cylindrical cover.

In accordance with an aspect of the present disclosure, a cleaner includes a main body having a suction port, a brush unit rotatably provided at the suction port, and a cleaning module having a cutting unit configured to remove foreign matter entangled with the brush unit, wherein a blade of the cutting unit extends in a radial direction of the brush unit to cut the foreign matter entangled with the brush unit.

Advantageous Effects

In accordance with embodiments of the present disclosure, it may be possible to remove foreign matters such as hair, which are entangled in the brush unit, without stopping operation of the cleaner, thereby improving cleaning efficiency.

Further, it may be possible to solve problems of inconvenience that a user has to separate the brush unit from the main body in order to remove foreign matters such as hair, which are entangled in the brush unit.

In addition, since the blade of the cutting unit of the cleaning module is disposed in the radial direction of the brush drum, the blade of the cutting unit may be disposed adjacent to the brush drum without damaging the brush, thereby removing foreign matters such as hair wound on the brush drum.

MODE FOR INVENTION

Hereinafter, exemplary embodiments according to the present disclosure will be described in detail.

In the following description, a front side refers to a forward direction with respect to a main body of the cleaner, an upper side refers to an upward direction with respect to the main body of the cleaner, and a lower side refers to a downward direction with respect to the main body of the cleaner.

Figure 1:
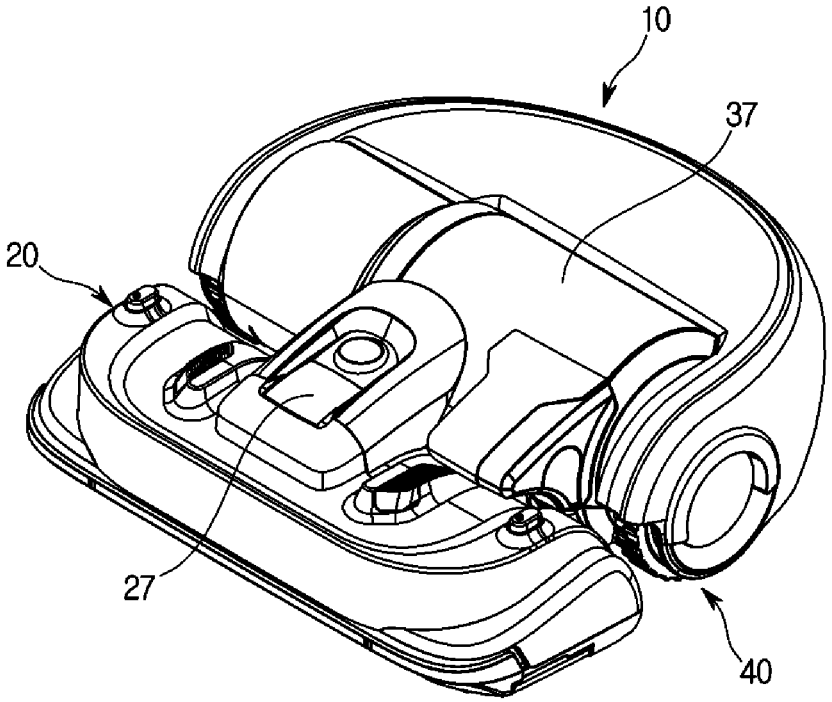
FIG. 1 is a perspective view illustrating a cleaner according to an embodiment of the present disclosure.
Figure 2:
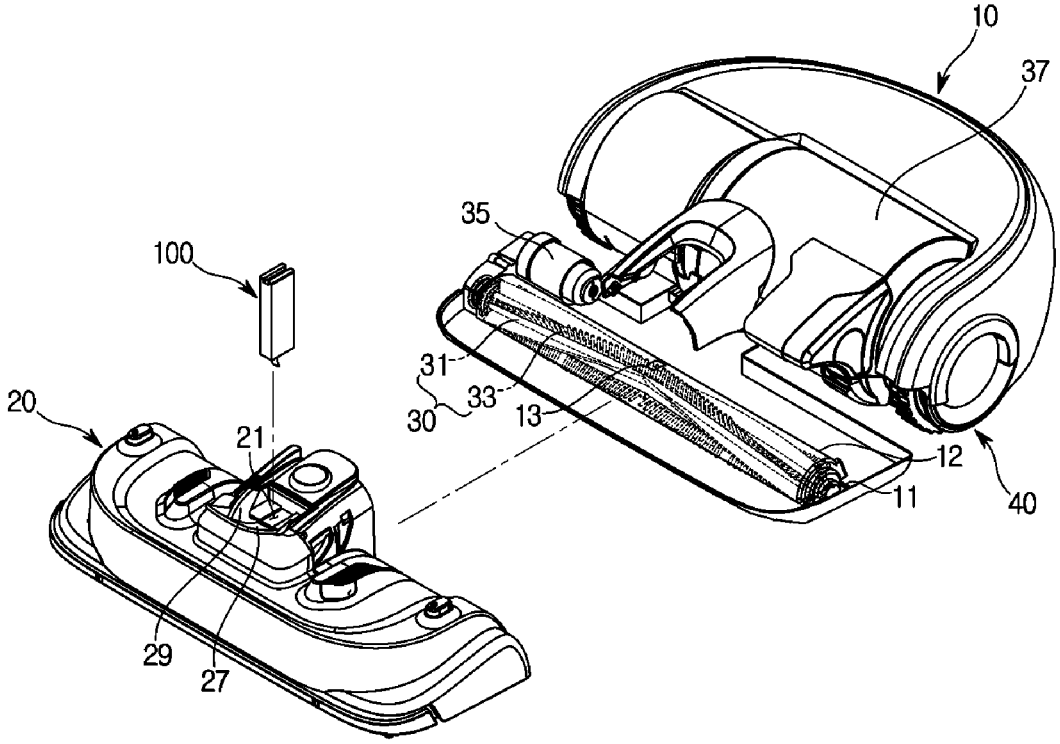
FIG. 2 is a view illustrating a state in which a cover is separated from a main body of a cleaner according to an embodiment of the present disclosure and a cleaning module is being received in the cover.
Figure 3:
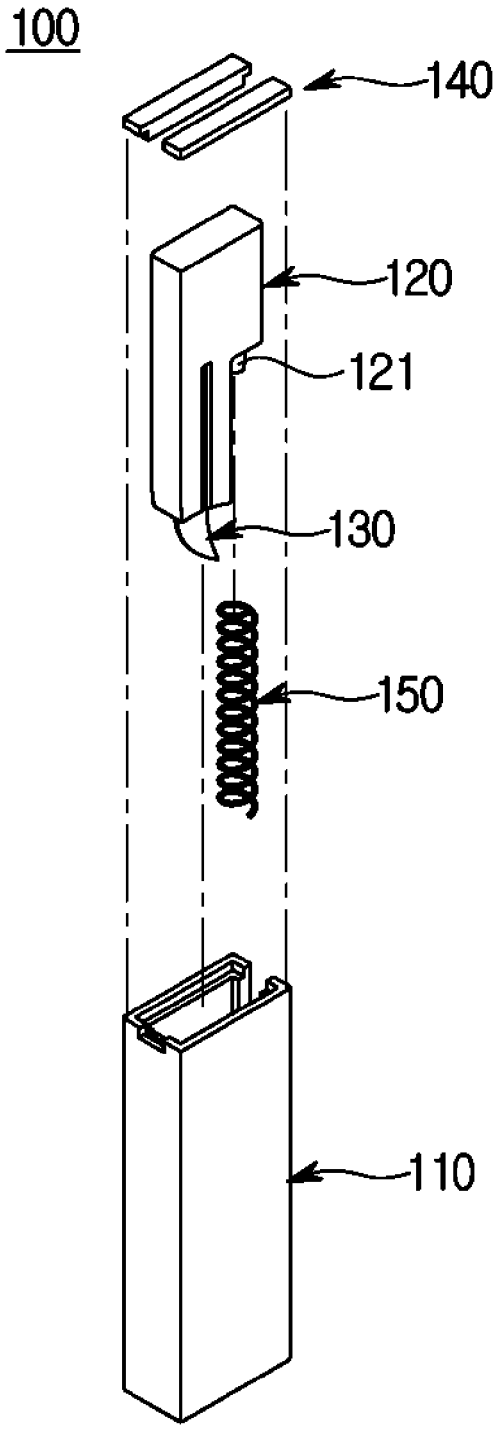
FIG. 3 is an exploded perspective view illustrating a cleaning module according to an embodiment of the present disclosure

As illustrated in FIGS. 1 and 2, a cleaner includes a main body 10 forming an outer appearance, a brush unit 30 for sweeping or scattering dust in space to be cleaned, a driving device 40 for driving the main body 10, and a cleaning module 100 configured to remove foreign matters entangled in the brush unit 30.

The main body 10 forms the outer appearance of the cleaner, and supports various components installed therein.

The main body 10 may include a suction port 11 provided at a lower portion of the main body 10 to suction foreign matters such as dust existing in the space to be cleaned, a cylindrical cover 12 provided above the suction port 11 so as to cover the brush unit 30 provided at the suction port 11, and a cover 20 covering an upper part of a front side of the main body 10

The cover 20 may be provided with a receiving portion 21 in which the cleaning module 100 is detachably received.

The brush unit 30 includes a drum-shaped brush drum 31 rotatably mounted at the suction port 11 and a brush 33 provided on an outer peripheral surface of the brush drum 31. The brush unit 30 is housed inside the cylindrical cover 12.

The brush drum 31 is rotated by a brush motor 35. The foreign matters such as dust scattered by the brush unit 30 are suctioned through the suction port 11, and the foreign matters suctioned through the suction port 11 are collected in a dust box 37 via a hose H.

The brush unit 30 improves the suction efficiency by sweeping or scattering the foreign matters such as dust existing on a floor surface under the main body 10.

Although not shown in the drawing, the brush unit 30 may further include a side brush (not shown) disposed on opposite sides of a lower portion of the main body 10 to sweep the dust that the brush unit 30 provided at the suction port 11 is unable to sweep, thereby improving the cleaning efficiency.

The driving device 40 is rotated by a driving motor (not shown) so that the main body 10 moves for cleaning.

As illustrated in FIGS. 2 to 5, the cleaning module 100 for removing foreign matters entangled in the brush unit 30 may include a housing 110 that is detachably received in the cover 20 of the main body 10, a cartridge 120 provided in the housing 110 to be movable in a vertical direction, and a cutting unit 130 provided at a lower portion of the cartridge 120 to cut the foreign matters entangled in the brush unit 30.

The cover 20 is provided with the receiving portion 21 in which the housing 110 of the cleaning module 100 is replaceably accommodated. An upper opening 23 through which the housing 110 is received may be provided at an upper portion of the receiving portion 21, and a lower opening 25 through which the cutting unit 130 is moved in the vertical direction may be provided in a lower portion of the receiving portion 21.

A lid 27 for opening or closing the receiving portion 21 is rotatably coupled to the upper opening 23. A pressing portion 29 may be provided at a lower portion of the lid 27 to press an upper portion of the cartridge 120 such that the cartridge 120 is moved downward.

The housing 110 is provided such that the upper and lower portions thereof are opened, and is replaceably accommodated in the receiving portion 21.

The cartridge 120 is provided in the housing 110 to be movable in a vertical direction, and the cutting unit 130 is provided at a lower portion of the cartridge 120.

A spring 150 may be provided between the housing 110 and the cartridge 120. Support portions 111 and 121 may be provided at the housing 110 and the cartridge 120 to support the spring 150.

The support portions 111 and 121 may include a first support portion 111 provided at the housing 110 to support one end of the spring 150 and a second support portion 121 provided at the cartridge 120 to support the other end of the spring 150.

The cartridge 120 is elastically supported by the housing 110 via the spring 150 such that the spring 150 is compressed to store elastic force when the upper portion of the cartridge 120 is pressed and the cartridge 120 is moved downward, and the cartridge 120 is moved upward by the stored elastic force when the force for pressing the upper portion of the cartridge 120 is released.

A pair of anti-release members 140 may be provided at an upper portion of the housing 110 to prevent the cartridge 120 accommodated in the housing 110 from being moved upward and released out of the housing 110.

The receiving portion 21 in which the housing 110 is accommodated may be provided above a central portion of the cylindrical cover 12 in which the brush unit 30 is housed such that the cutting unit 130 of the cleaning module 100 may be disposed at a central portion of the brush unit 30.

The cylindrical cover 12 is provided with an opening portion 13 at a position corresponding to the lower opening 25 of the receiving portion 21. When the cartridge 120 is moved downward within the housing 110, the cutting unit 130 is moved downward through the open lower portion of the housing 110, the lower opening 25 of the receiving portion 21 and the opening portion 13 of the cylindrical cover 12 to be inserted into the cylindrical cover 12. The cutting unit 130 inserted into the cylindrical cover 12 cuts the foreign matters such as hair entangled in the brush unit 30.

The reason that the cutting unit 130 is disposed at the central portion of the brush unit 30 is that the foreign matter such as the hair wound on the brush unit 30 is moved from both ends to the central portion of the brush unit 30 and then concentrated at the central portion of the brush unit 30.

The cutting unit 130 is disposed at the central portion of the brush unit 30. A blade of the cutting unit 130 is arranged to extend in a radial direction of the brush unit 30 not to come into contact with the brush 33 of the brush unit 30 to prevent damage to the brush 33.

In addition, since the blade of the cutting unit 130 is arranged to extend in the radial direction of the brush drum 31, the blade of the cutting unit 130 may be disposed adjacent to the brush drum 31 without damaging the brush 33 and it is possible to remove most of the foreign matters such as hair wound on the brush drum 31.

The foreign matters such as hair cut by the cutting unit 130 may be transferred to the dust box 37 through the hose H together with other foreign matters such as dust that are suctioned through the suction port 11.

Next, the operation in which the cleaning module 100 is being received in the receiving portion 21 and the operation in which a position of the cutting unit 130 is changed by opening and closing the lid 27 after the cleaning module 100 is received in the receiving portion 21 will be described with reference to FIGS. 5 to 7.

Figure 5:
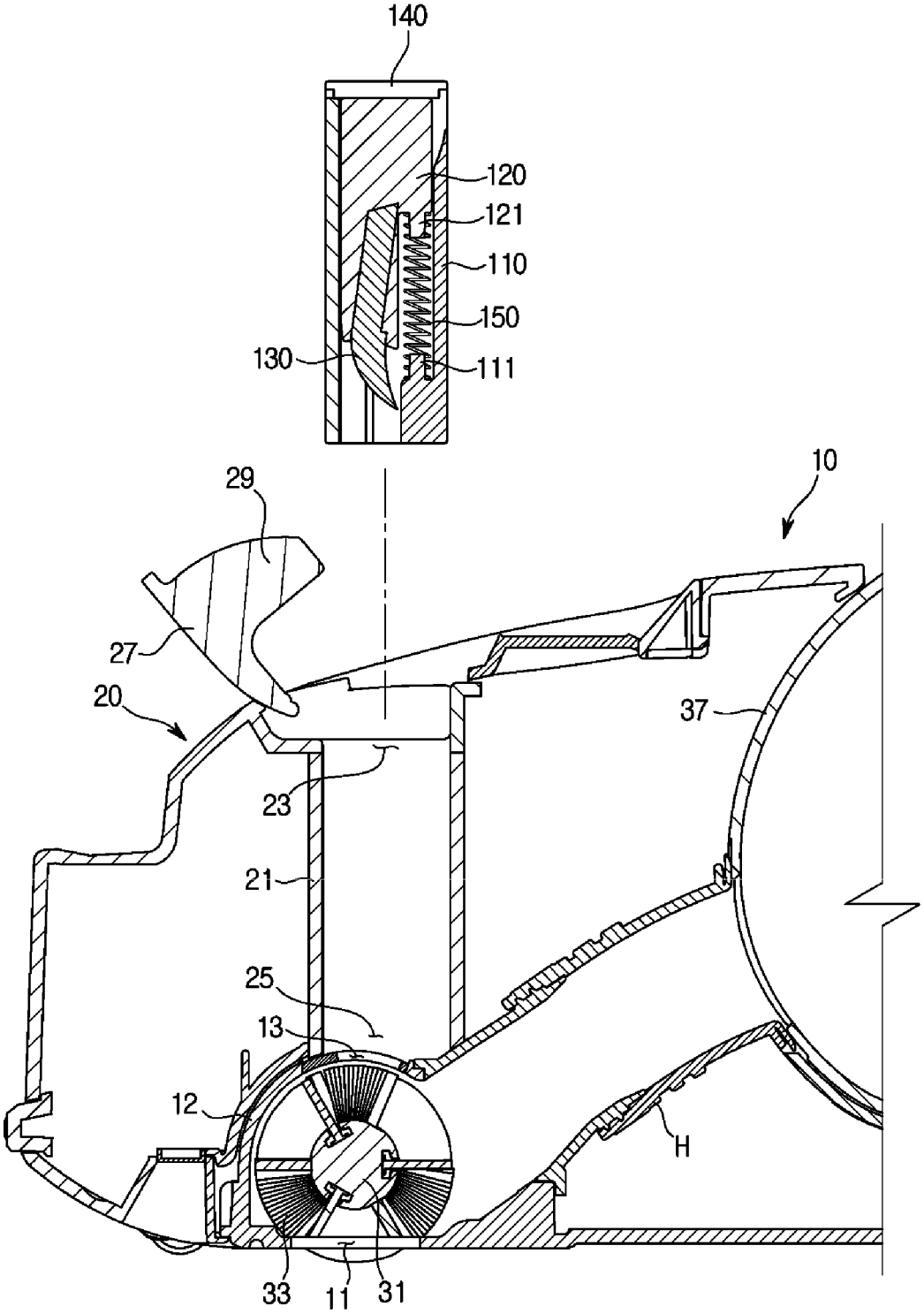
FIG. 5 is a cross-sectional view illustrating a state in which a cleaning module of a cleaner according to an embodiment of the present disclosure is being received in a receiving portion.

As illustrated in FIG. 5, when the cleaning module 100 is to be received in the receiving portion 21, the lid 27 provided on the cover 20 is opened.

Figure 6:
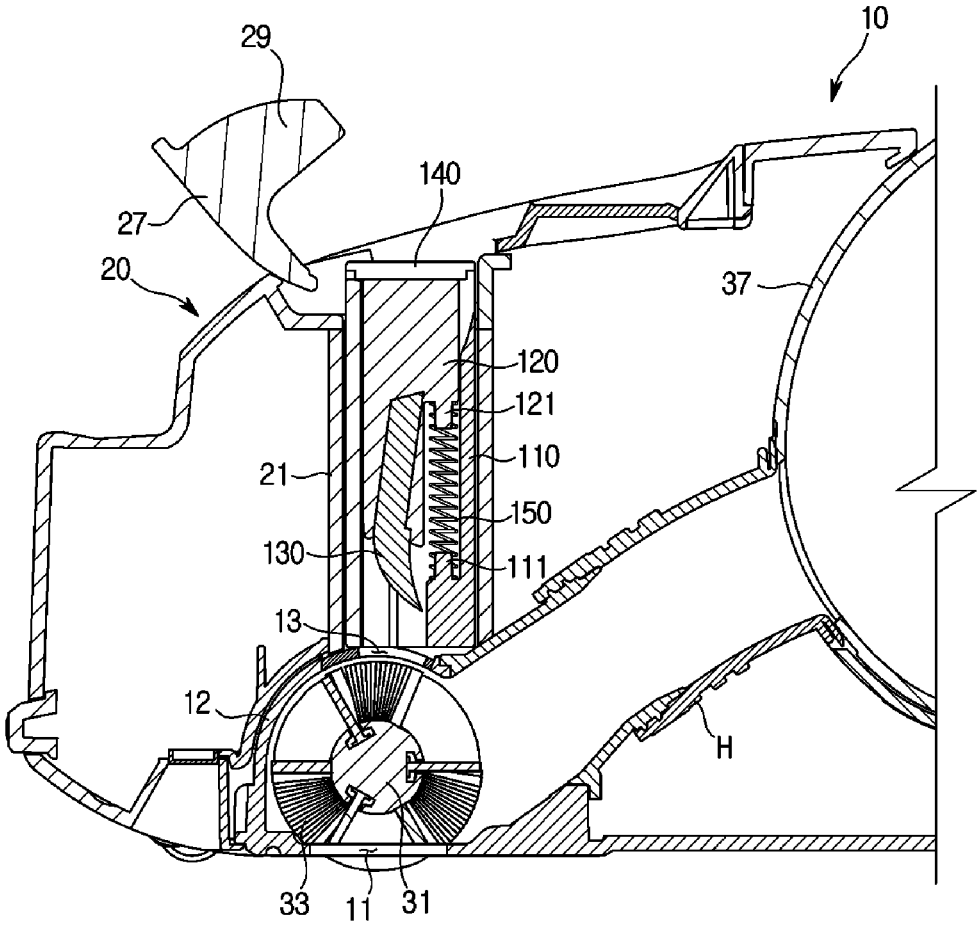
FIG. 6 is a cross-sectional view illustrating a state in which a cleaning module of a cleaner according to an embodiment of the present disclosure is received in a receiving portion.

The cartridge 120 is moved upwards in the housing 110 by the elastic force of the spring 150, when the cleaning module 100 is received in the receiving portion 21 through the upper opening 23 of the receiving portion 21 with the lid 27 opened as illustrated in FIG. 6.

The cartridge 120 is prevented from being released out of the housing 110 by the anti-release member 140 provided at the upper portion of the housing 110, and the cutting unit 130 provided at the lower portion of the cartridge 120 is accommodated in the housing 110.

Figure 7:
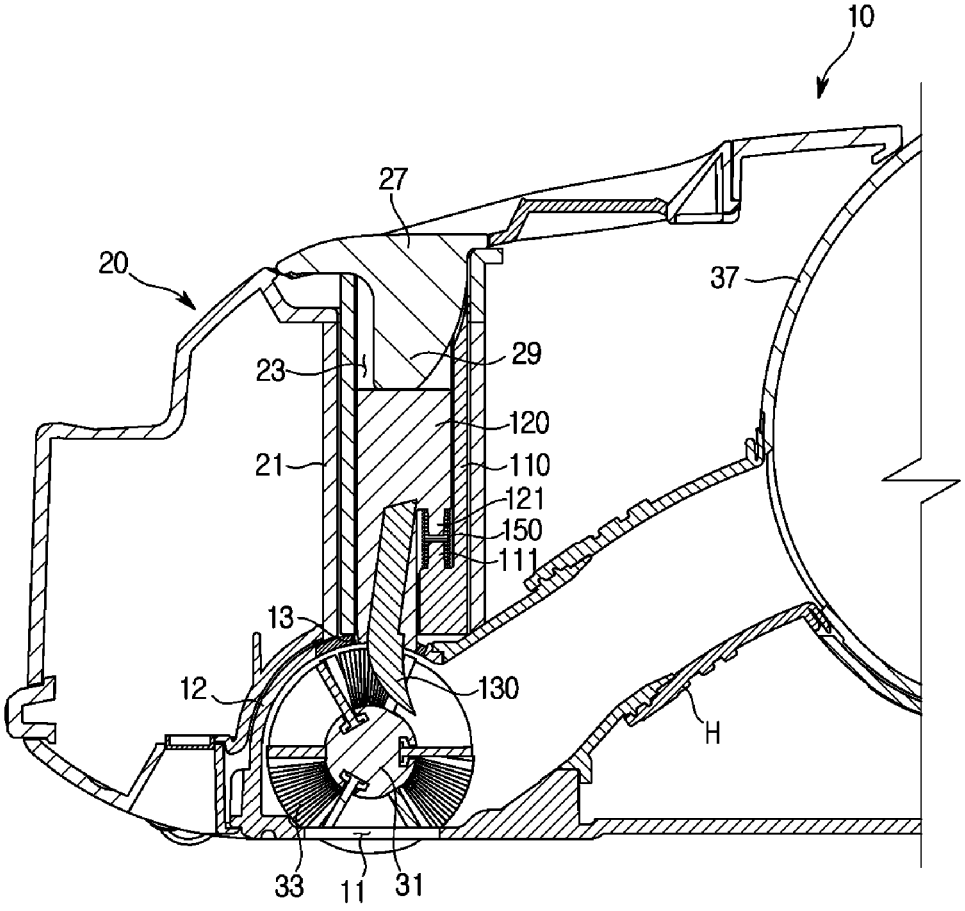
FIG. 7 is a cross-sectional view illustrating a state in which a cartridge is pressed by a pressing portion and a cutting unit is inserted into a cylindrical cover after a cleaning module of a cleaner according to an embodiment of the present disclosure is received in a receiving portion.

As illustrated in FIG. 7, when the lid 27 is closed in a state where the cleaning module 100 is received in the receiving portion 21, the pressing portion 29 of the lid 27 presses the upper portion of the cartridge 120 downwards.

The cartridge 120 pressed by the pressing portion 29 is moved downwards while pressing the spring 150. The cutting unit 130 provided at the lower portion of the cartridge 120 is inserted into the cylindrical cover 12 through the open lower portion of the housing 110, the lower opening 25 of the receiving portion 21 and the opening portion 13 of the cylindrical cover 12 to move to a position where the cutting unit 130 is able to cut the foreign matter such as hair that is entangled in the brush unit 30.

When the cleaner is operated in a state where the cutting unit 130 is moved to a position where it is able to cut the foreign matter such as hair entangled in the brush unit 30, the foreign matter such as hair entangled in the brush unit 30 is cut and separated from the brush unit 30, and the separated foreign matter is moved to the dust box 37 through the hose H.

Since the foreign matter such as hair is all transferred to the dust box 37 without being entangled in the brush unit 30, the brush unit 30 may be smoothly rotated, thereby improving the cleaning efficiency.

In a case that the cutting unit 130 is worn out and needs to be replaced, when the lid 27 is opened as illustrated in FIG. 6 in a state where the operation of the cleaner is stopped, the cartridge 120 is moved upward by the stored elastic force of the spring 150.

Since the cutting unit 130 is received in the housing 110 when the cartridge 120 is moved upward, it is possible to prevent a user from getting injured by the cutting unit 130 when the user removes the cleaning module 100 from the receiving portion 21.

Next, another embodiment of the cleaning module will be described with reference to FIGS. 8 to 14.

Figure 8:
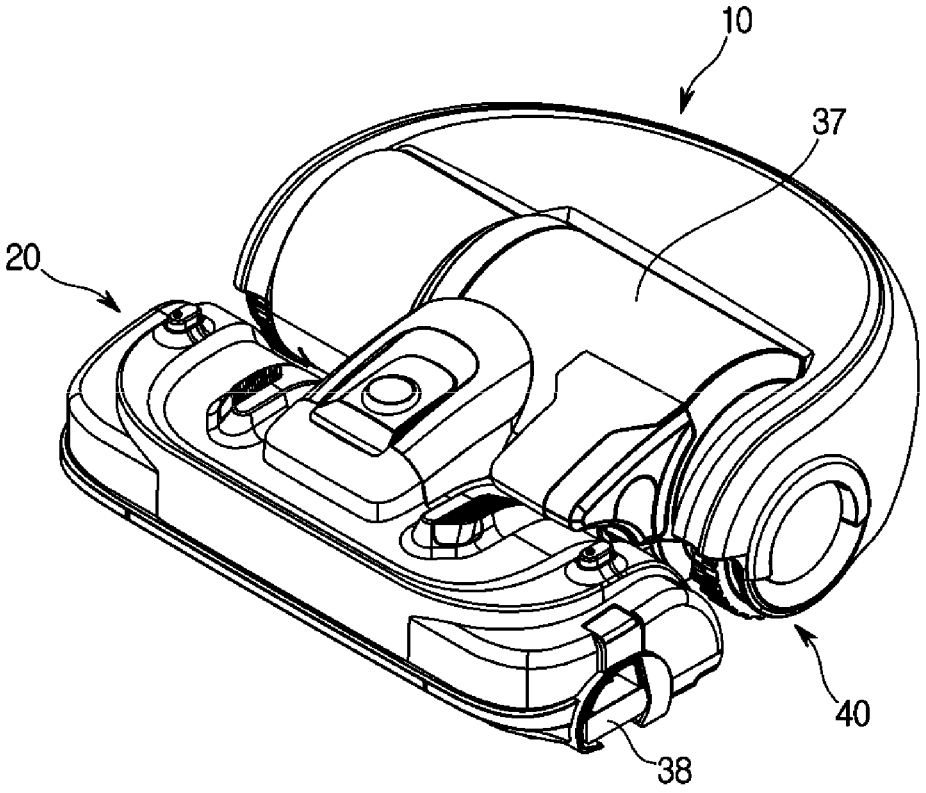
FIG. 8 is a perspective view illustrating a cleaner according to another embodiment of the present disclosure.
Figure 9:
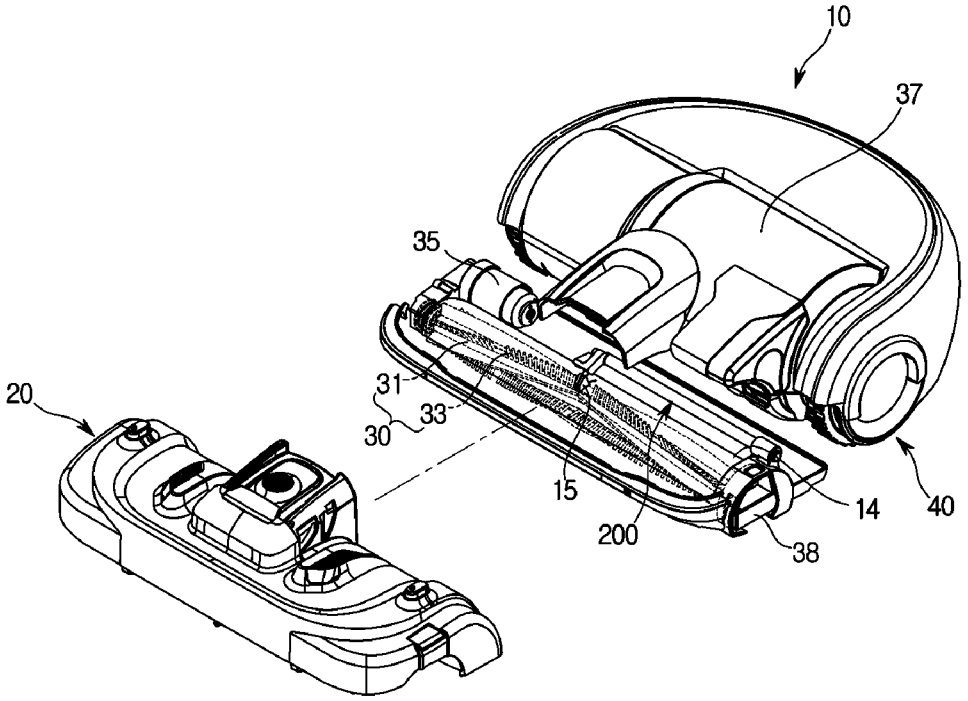
FIG. 9 is a view illustrating a state in which a brush unit of a cleaner according to another embodiment of the present disclosure is being housed in a cylindrical cover.
Figure 10:
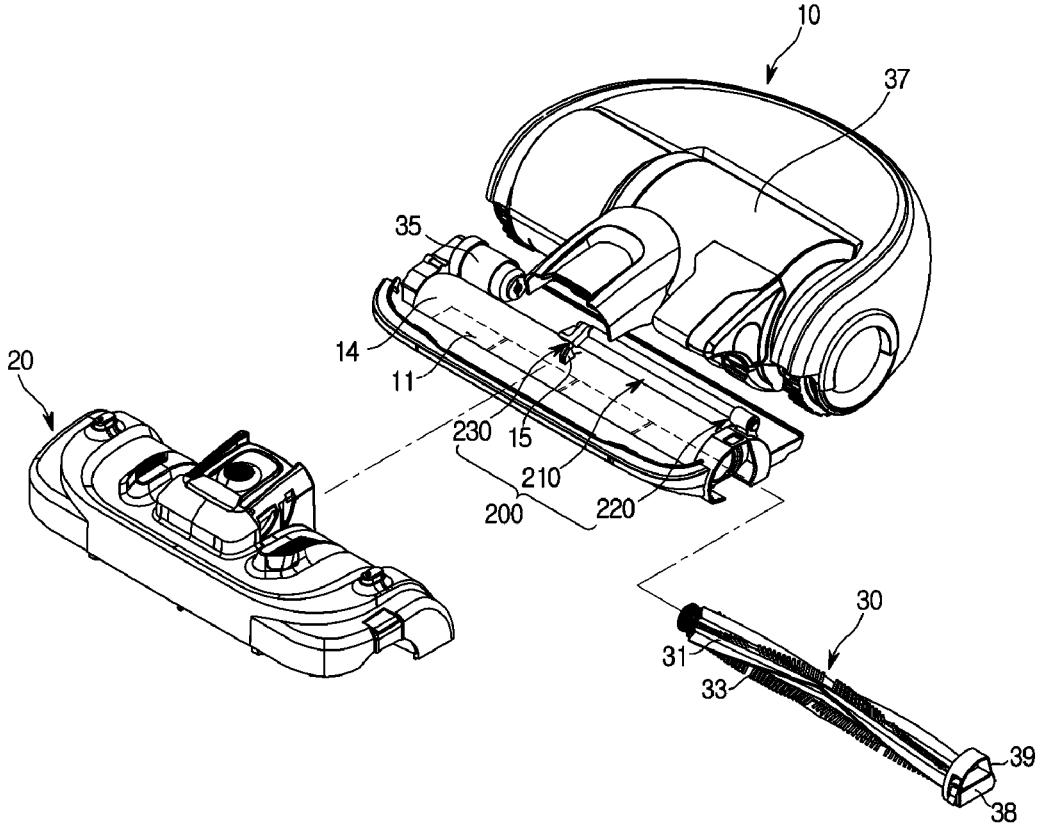
FIG. 10 is a view illustrating a state in which a brush unit of a cleaner according to another embodiment of the present disclosure is housed in a cylindrical cover.

As illustrated in FIGS. 8 to 10, a cleaner includes the main body 10 forming an outer appearance, the brush unit 30 for sweeping or scattering dust in space to be cleaned, the driving device 40 for driving the main body 10, and a cleaning module 200 configured to remove foreign matters entangled in the brush unit 30.

Since the configuration of the driving device 40 is the same as that of the driving device shown in FIGS. 1 and 2, a description thereof will be omitted, but different configurations from those of the main body 10 and the brush unit 30 as shown in FIGS. 1 and 2 will be described.

The main body 10 is provided with a cylindrical cover 14 in the same manner as the cleaner illustrated in FIGS. 1 and 2. A support portion 15 for supporting a cutting unit 230 of the cleaning module 200 may be provided at a central portion of the cylindrical cover 14. A penetrating portion 16 may be formed in a lower portion of the support portion 15 to allow the cutting unit 230 to pass through and be inserted to the cylindrical cover 14 (see FIG. 12).

One side of the cylindrical cover 14 is open to allow the brush unit 30 to be received in the cylindrical cover 14.

The main body 10 may be provided with a torsion spring supporting portion 17 for supporting a torsion spring 240 of the cleaning module 200 as will be described below.

The cover 20 of the main body 10 may not have the receiving portion 21 and the lid 27 for opening and closing the receiving portion 21 as illustrated in FIGS. 1 and 2.

The configuration of the brush unit 30 including the brush drum 31 and the brush 33 is the same as that of the brush unit illustrated in FIGS. 1 and 2. However, a rotary unit 38 may further be rotatably provided at one of opposite ends of the brush unit 30.

As illustrated in FIG. 9, the cleaning module 200 may include a rotation bar 210 rotatably provided in the main body 10, a rotation guide part 220 provided on one side of the rotation bar 210 to cause the rotation bar 210 to rotate by rotation of the rotary unit 38, and the cutting unit 230 provided on the other side of the rotation bar 210 to cut foreign matters such as hair entangled in the brush unit 30.

The rotation bar 210 is rotatably provided in the main body 10 and elastically supported by the torsion spring supporting portion 17 of the main body 10 via the torsion spring 240.

The rotation guide part 220 provided on the one side of the rotation bar 210 is in contact with the rotary unit 38 of the brush unit 30 accommodated in the cylindrical cover 14 to cause the rotation bar 210 to rotate in a direction opposite to a rotation direction of the rotary unit 38 when the rotary unit 38 is rotated.

The cutting unit 230 provided on the other side of the rotation bar 210 is positioned at the center of the upper portion of the cylindrical cover 14 and supported by the support portion 15.

Figure 4:
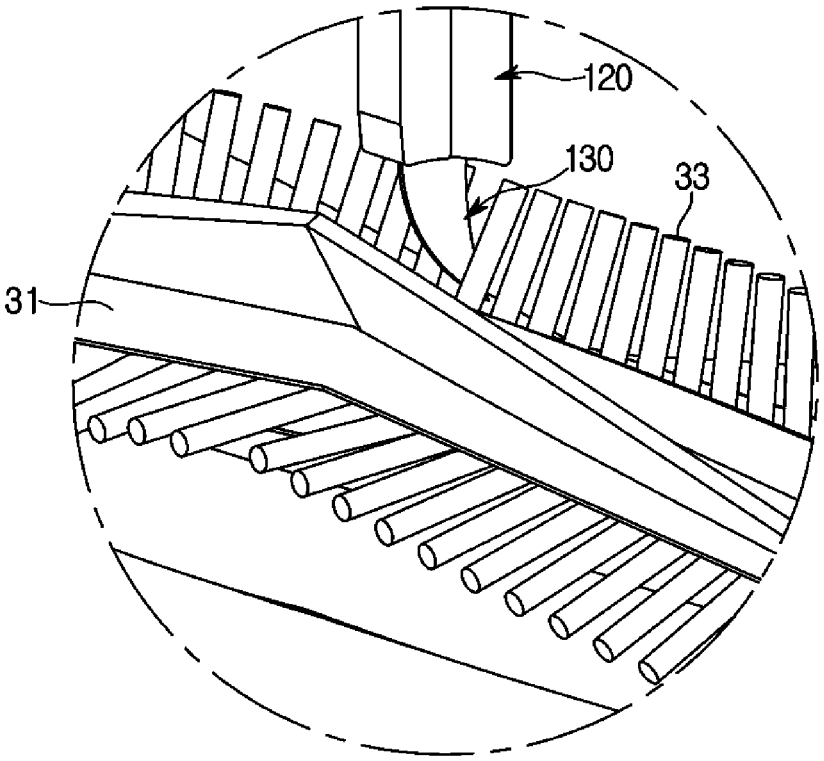
FIG. 4 is a view illustrating a cutting unit of a cleaner according to an embodiment of the present disclosure, which is arranged in a radial direction of a brush unit.

The cutting unit 230 is disposed such that a blade of the cutting unit 230 extends in a radial direction of the brush unit 30 like the cutting unit 130 illustrated in FIG. 4.

Figure 11:
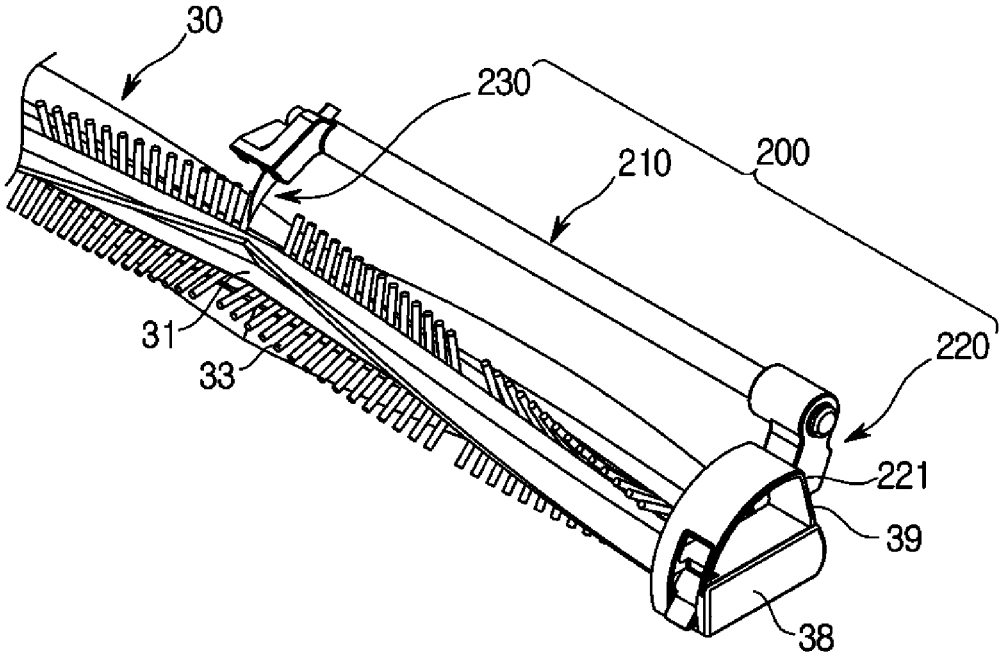
FIG. 11 is a view illustrating the brush unit and the cleaning module of FIG. 10.
Figure 12:
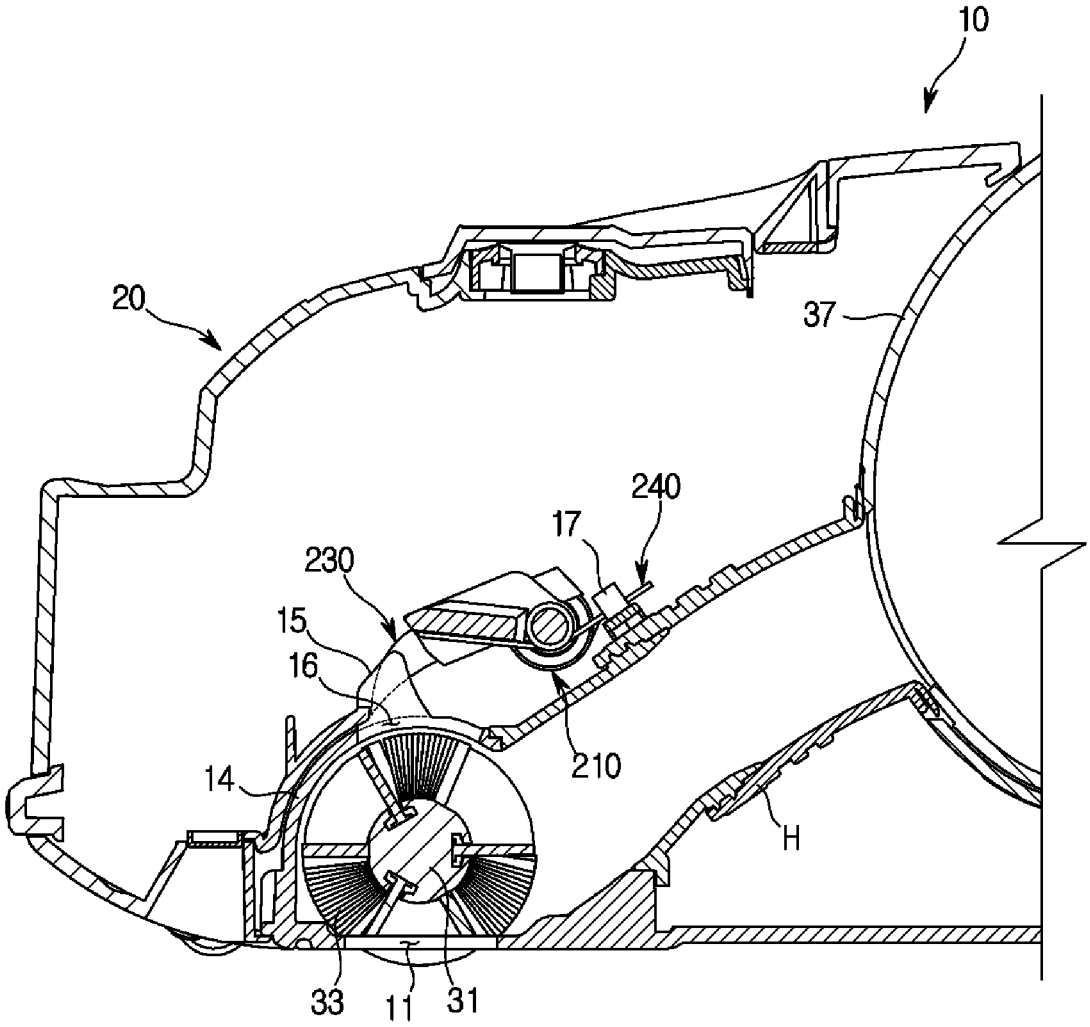
FIG. 12 is a cross-sectional view illustrating a state in which a brush unit of a cleaner according to another embodiment of the present disclosure is housed in a cylindrical cover.

As illustrated in FIGS. 10 to 12, a first contact portion 39 of the rotary unit 38 comes into contact with a second contact portion 221 of the rotation guide part 220 when the brush unit 30 is received in the cylindrical cover 14.

The cutting unit 230 is not inserted into the cylindrical cover 14 but supported by the support portion 15 on the outside of the cylindrical cover 14.

Figure 13:
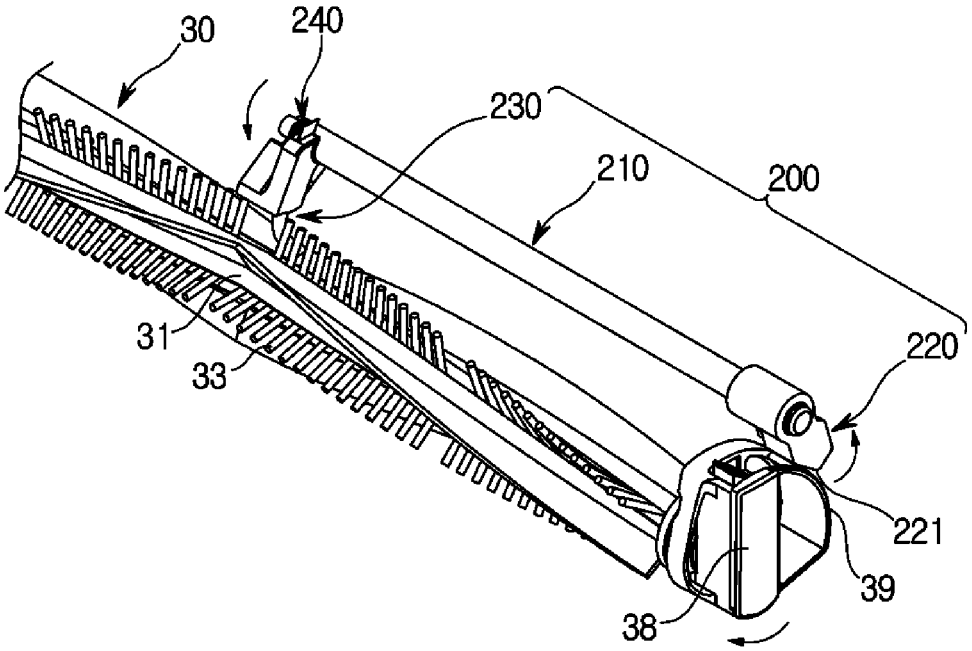
FIG. 13 is a view illustrating a state in which a brush unit of a cleaner according to another embodiment of the present disclosure is housed in a cylindrical cover and then rotated in a clockwise direction.
Figure 14:
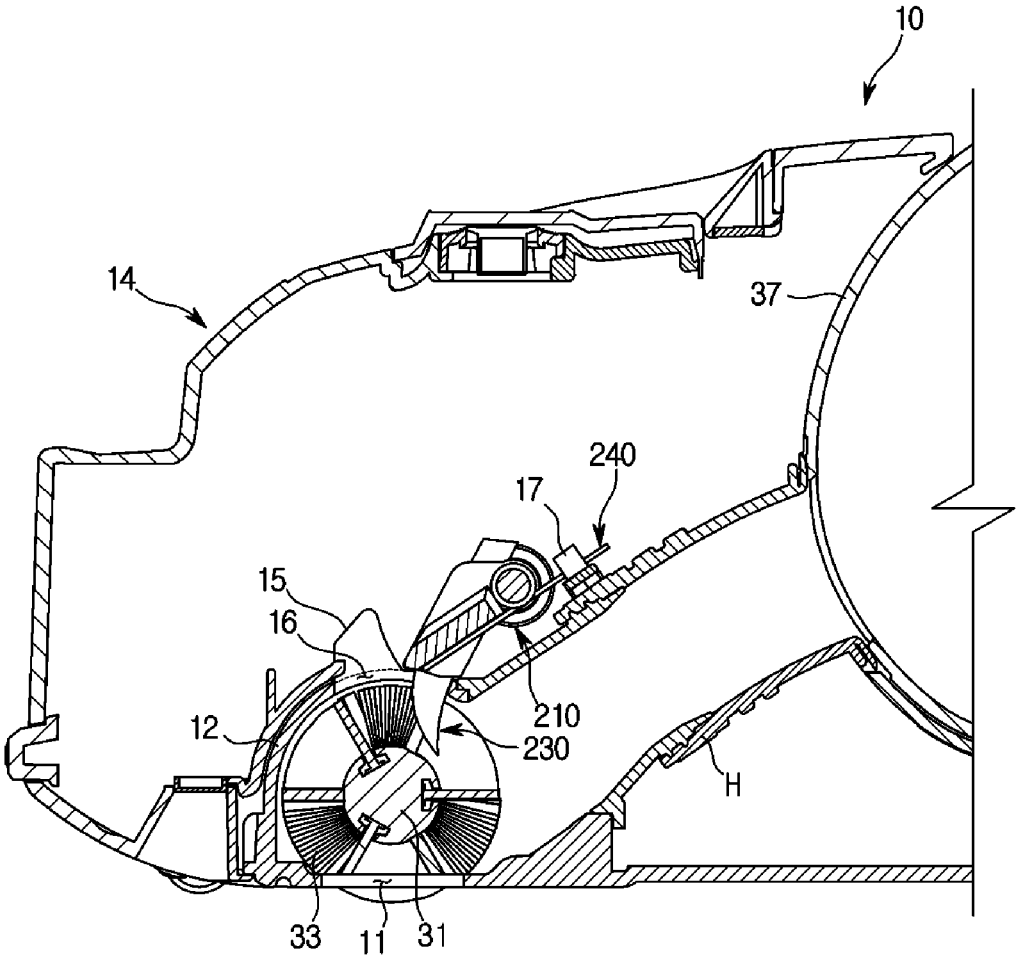
FIG. 14 is a cross-sectional view illustrating a state in which a brush unit of a cleaner according to another embodiment of the present disclosure is housed in a cylindrical cover and then rotated in a clockwise direction to insert a cutting unit into the cylindrical cover.

When the rotary unit 38 is rotated in a first direction which is a clockwise direction as illustrated in FIGS. 13 and 14 after the brush unit 30 is received in the cylindrical cover 14, the rotation guide part 220 in contact with the rotary unit 38 is rotated in a second direction which is a counterclockwise direction to cause the rotation bar 210 to rotate in the second direction.

When the rotation bar 210 is rotated in the counterclockwise direction, the cutting unit 230 provided on the other side of the rotation bar 210 also rotates in the second direction which is the counterclockwise direction such that the cutting unit 230 is inserted into the cylindrical cover 14 through the penetrating portion 16 and moved to a position where it is able to cut the foreign matter such as hair entangled in the brush unit 30.

Then, the torsion spring 240 elastically supporting the rotation bar 210 is pressed to store elastic force.

When the cleaner is operated in a state where the cutting unit 130 is moved to the position where it is able to cut the foreign matter such as hair entangled in the brush unit 30, the foreign matter such as hair entangled in the brush unit 30 is cut and separated from the brush unit 30, and the separated foreign matter is moved to the dust box 37 through the hose H.

Since the foreign matter such as hair is transferred to the dust box 37 without being entangled in the brush unit 30, the brush unit 30 may be smoothly rotated, thereby improving the cleaning efficiency.

To separate the brush unit 30 from the cylindrical cover 14 to clean the brush unit 30 or the inside of the cylindrical cover 14 after the operation of the cleaner is stopped, the rotary unit 38 is rotated counterclockwise.

When the rotary unit 38 is rotated counterclockwise to the end while the first contact portion 39 of the rotary unit 38 is in contact with the second contact portion 221 of the rotation guide part 220, the rotation bar 210 is rotated in the clockwise direction by the stored elastic force of the torsion spring 240.

When the rotation bar 210 is rotated clockwise, the second contact portion 221 of the rotation guide part 220 is kept in contact with the first contact portion 39 of the rotary unit 38 and the cutting unit 230 also rotates clockwise.

When the cutting unit 230 is rotated clockwise, the cutting unit 230 is moved outside of the cylindrical cover 14 through the penetrating portion 16 and supported by the support portion 15.

Since the brush unit 30 is detached from the cylindrical cover 14 or the inside of the cylindrical cover 14 is cleaned in a state where the cutting unit 230 is moved outside of the cylindrical cover 14, it is possible to prevent a user from being damaged such as injured by the cutting unit 230.

Although the cleaner has been described with reference to a robot cleaner illustrated in FIGS. 1 to 14, the cleaning modules 100 and 200 may be used for all types of vacuum cleaners, such as a canister-, an upright-, and a stick-type vacuum cleaners including the brush drum 31 and the brush 33.

Although a specific shape and direction are focused on in describing a cleaner with reference to the accompanying drawings, it is understood by those skilled in the art that various changes and modifications may be made therein without departing from the scope of the disclosure.

The invention claimed is:

1. A cleaner comprising:

a main body including a suction port;

a brush unit rotatably provided at the suction port; and a cleaning module detachably received in the main body and configured to remove foreign matter entangled in the brush unit, wherein the cleaning module comprises:

a housing detachably received in the main body, a cartridge provided in the housing and configured to be movable in a vertical direction, between a locked position and an unlocked position, and a cutting unit provided at a lower portion of the cartridge and configured to cut the foreign matter entangled in the brush unit in case the cartridge is in the locked position, and wherein the cutting unit comprises a curved blade having an end point that is directed away from an axis of rotation of the brush unit.

2. The cleaner according to claim 1, wherein the brush unit comprises:

a brush drum having a drum shape, and a brush provided on an outer peripheral surface of the brush drum, and wherein the brush unit is housed in a cylindrical cover.

3. The cleaner according to claim 2, wherein a receiving portion to receive the cleaning module is provided above a central portion of the cylindrical cover, and wherein the receiving portion includes an upper opening through which the housing is received and a lower opening through which the cutting unit is vertically moved.

4. The cleaner according to claim 3, wherein the cylindrical cover is provided with an opening portion at a position corresponding to the lower opening.

5. The cleaner according to claim 4, wherein a lid is coupled to the main body to open or close the upper opening and the lid includes a pressing portion provided at a lower portion of the lid to press the cartridge.

6. A cleaner comprising:

a main body including a suction port;

a brush unit rotatably provided at the suction port; and a cleaning module detachably received in the main body and configured to remove foreign matter entangled in the brush unit, wherein the cleaning module comprises:

a housing detachably received in the main body, a cartridge provided in the housing to be movable in a vertical direction, and a cutting unit provided at a lower portion of the cartridge and configured to cut the foreign matter entangled in the brush unit, wherein the brush unit comprises:

a brush drum having a drum shape, and a brush provided on an outer peripheral surface of the brush drum, wherein the brush unit is housed in a cylindrical cover, wherein a receiving portion to receive the cleaning module is provided above a central portion of the cylindrical cover, wherein the receiving portion includes an upper opening through which the housing is received and a lower opening through which the cutting unit is vertically moved, wherein the cylindrical cover is provided with an opening portion at a position corresponding to the lower opening, wherein a lid is coupled to the main body to open or close the upper opening and the lid includes a pressing portion provided at a lower portion of the lid to press the cartridge, and wherein a pair of anti-release members are provided at an upper portion of the housing to prevent the cartridge from being released to the outside through the upper opening.

7. The cleaner according to claim 6, wherein the housing and the cartridge include support portions for supporting a first end and a second end of a spring, respectively, such that the cartridge is elastically supported by the housing via the spring.

8. The cleaner according to claim 7, wherein the pressing portion presses an upper portion of the cartridge such that the cartridge is moved downward inside the housing, when the lid is closed after the cleaning module is received in the receiving portion.

9. The cleaner according to claim 8, wherein the cutting unit is inserted into the cylindrical cover through the lower opening and the opening portion when the cartridge is moved downward.

10. The cleaner according to claim 9, wherein the spring is compressed to store elastic force when the cartridge is moved downward.

11. The cleaner according to claim 10, wherein the cutting unit is disposed at a central portion of the brush unit, and wherein a blade of the cutting unit extends in a radial direction of the brush unit to be disposed to cut the foreign matter entangled in the brush unit.

12. The cleaner according to claim 11, wherein the cartridge is released from the pressing portion and moved upward in the housing due to the elastic force of the spring when the lid is opened.

13. The cleaner according to claim 12, wherein the cutting unit is received in the housing when the cartridge is moved upward.

* * * * *